US006463961B1

(12) United States Patent
Iizuka

(10) Patent No.: US 6,463,961 B1
(45) Date of Patent: Oct. 15, 2002

(54) DUCT HANGER AND METHOD FOR HANGING DUCT USING HANGER

(75) Inventor: Shozo Iizuka, Himeji (JP)

(73) Assignee: Air System Kabushiki Kaisha, Hyogo (JP)

( * ) Notice: Subject to any disclaimer, the term of this patent is extended or adjusted under 35 U.S.C. 154(b) by 0 days.

(21) Appl. No.: 09/914,102

(22) PCT Filed: Feb. 18, 2000

(86) PCT No.: PCT/JP00/00915

§ 371 (c)(1),
(2), (4) Date: Aug. 21, 2001

(87) PCT Pub. No.: WO00/50820

PCT Pub. Date: Aug. 31, 2000

(30) Foreign Application Priority Data

Feb. 22, 1999 (JP) ..... 11-043275

(51) Int. Cl.[7] ..... F16L 3/00

(52) U.S. Cl. ..... 138/107; 138/155; 138/162; 138/163; 248/58; 248/71; 248/301

(58) Field of Search ..... 138/107, 106, 138/155, 162, 163; 248/56, 58, 65, 71, 301, 339

(56) References Cited

U.S. PATENT DOCUMENTS 2,286,118 A * 6/1942 Sleeth ..... 248/58
3,280,530 A * 10/1966 Rothenbach ..... 138/111
4,101,108 A * 7/1978 Klein ..... 248/243
4,760,981 A * 8/1988 Hodges ..... 248/343
6,056,021 A 5/2000 Iizuka
6,315,489 B1 * 11/2001 Watanabe ..... 248/304

FOREIGN PATENT DOCUMENTS

JP 4-186050 7/1992
JP 10-47741 2/1998

* cited by examiner

*Primary Examiner*—James Hook
(74) *Attorney, Agent, or Firm*—Marshall, Gerstein & Borun

(57) ABSTRACT

A hanger comprises a contact portion that makes surface contact with one face of the duct; a tongue piece as an engagement member that protrudes from the contact portion toward a tip end; a base portion bent continuously with the contact portion and away from the duct so as to form a guide rail accommodating space between the base portion and the tongue piece; a pressing portion formed continuously with the base portion, for pressing a face adjacent to the one face toward the tip end of the tongue piece to allow the guide rail to be securely retained between the pressing portion and the tongue piece; and a member for mounting a hanging member to the base portion. A method for hanging the duct comprises inserting a tongue piece of the hanger into the groove-shaped space of the duct; and bending the pressing portion toward the guide rail to press the face adjacent to the one peripheral face of the duct, thereby fixing the hanger to the duct.

9 Claims, 16 Drawing Sheets

(a)

(b)

(a)

(b)

DUCT HANGER AND METHOD FOR HANGING DUCT USING HANGER

TECHNICAL FIELD

The present invention relates to a hanger that hangs a duct (hereinafter referred to as "duct" or "air-conditioning duct" ) having a box-shaped cross section and used for air-conditioning or ventilating equipment as one of building equipment, and a method for hanging the duct using the hanger.

BACKGROUND ART

The applicant filed an application relating to a novel air-conditioning duct in 1996. Thereafter, based on this application, the applicant filed an application of improved invention on May 9, 1997 (Japanese Laid-Open Patent Publication No. Hei. 10-47741).

The novel duct can be assembled easily and quickly as compared to the conventional duct, and is innovative because it can be assembled in a duct installing place. In addition, this novel duct is superior in configuration because assembling thereof can be conducted with a minimum of noise unlike conventional assembling. That is, this duct is advantageous in that it can be assembled without troubling people living in neighborhood or other operators during assembling in an area adjacent to housing areas or the like or in a construction site where another construction or installation is being conducted concurrently.

The duct can be easily and reliably held and hung by using the hanger encompassed by the above-identified application. With the hanger, it is not necessary to use a pair of right and left hanging members to hang the duct, unlike the conventional hanging method in which the duct is placed on the angle member horizontally mounted. That is, with this hanger, as shown in FIGS. 15, 16, the duct can be hung at a right or left portion independently in the longitudinal direction of the duct. In brief, the position at which the duct is hung can be selected with high degree of freedom.

However, in case of the hanger of FIG. 15, since the duct is engaged by its gravitational force, it might be disengaged when an acceleration is applied thereon from the opposite direction of the gravitational force, for example, when an earthquake occurs. In case of the hanger of FIG. 16, since two members are fixed by means of screws provided at a lower end of a hanging member (in this case, hanging rod), a hanging operation takes a lot of trouble, and during this operation, another operator must support the duct from below.

The present invention has been developed under the circumstances, and an object thereof is to provide a hanger and a hanging method using the hanger in which a hanging operation can be easily and quickly performed and a duct is prevented from being disengaged even when an upward external force (acceleration) is applied on the duct.

DISCLOSURE OF THE INVENTION

To solve the above-described technical problem, according to the first invention, there is provided a duct hanger in which an engagement means is inserted and engaged in a groove-shaped space between a guide rail protruding in a longitudinal direction of the duct and one of peripheral faces of the duct in which the guide rail is formed to allow the duct to be hung from a direction orthogonal to the longitudinal direction of the guide rail, the duct hanger comprising: a contact portion that makes surface contact with the one peripheral face of the duct; a tongue piece protruding from the contact portion toward a tip end thereof and constituting the engagement means; a base portion bent continuously with the contact portion and away from the duct so as to form a guide rail accommodating space between the base portion and the tongue piece; a pressing portion formed continuously with the base portion, for pressing a face adjacent to the one peripheral face toward a tip end of the tongue piece to allow the guide rail to be securely retained between the pressing portion and the tongue piece; and means for mounting a hanging member to the base portion.

According to the duct hanger so structured, by inserting and engaging the tongue piece into the groove-shaped space between the guide rail and the one peripheral face in the state in which the contact portion is in contact with the one peripheral face of the duct, the face adjacent to the one peripheral face can be pressed by the pressing portion of the hanger, and in this state, the duct can be hung from the direction orthogonal to the guide rail. In other words, in the state in which the guide rail is accommodated in the guide rail accommodating space, the duct can be hung by pressing the face adjacent to the one peripheral face to enable the guide rail to be securely retained between the tongue piece and the pressing portion via the face adjacent to the one peripheral face. Therefore, in this state, by mounting the hanger to the hanging member by means of the mounting means, the duct can be hung by the hanging member hanging from a desired portion of the ceiling or the like.

Consequently, the duct can be easily and quickly hung by using the hanger, and thus hung duct remains engaged if the upward acceleration is applied thereon, because the duct is securely retained between the pressing portion and the tongue piece.

In the duct hanger according to the first invention, the pressing portion is coplanar with the base portion and, when the duct is hung, the pressing portion is bent toward the guide rail to allow the guide rail to be securely retained between the pressing portion and the tongue piece as described above. Since the guide rail can be fixed between the pressing portion and the tip end of the tongue piece with very little space, the duct can be hung without "play" even if an external force causing disengagement is applied on the duct.

The duct hanger may be provided with means formed between the base portion and the pressing portion, for facilitating bending. Thereby, the pressing portion can be easily bent by using a commercially available tool (for example, plyer, pench, or a monkey spanner) and without the need for a large force.

In the hanger, the means for facilitating bending is constituted by a penetrating hole formed at the center of a bent portion. Thus, the facilitating means can be formed by a simple process.

In the hanger, the tongue piece and the contact portion are formed as a flat plate, and the base portion is formed as a flat plate parallel to the tongue piece and the contact portion such that the base portion is bent continuously with the contact portion and toward the opposite side of the duct with respect to the tongue piece. This configuration is simple. In addition, this configuration is preferable because the buckling load resistance of the tongue piece and hence, the load resistance to the stress from the duct can be increased, and a contact area can be increased to thereby reduce the influence of an impact load on the duct.

In the hanger, the mounting means may be constituted by a penetrating hole formed in an extended portion that is formed at a tip end of the base portion and bent by substantially 90 degrees with respect to the base portion and away from the guide rail.

Also, in the hanger, the mounting means may be constituted by a penetrating hole formed in an extended portion formed at the tip end of the base portion so as to be coplanar with the base portion.

It is preferable that the penetrating hole is an elongated penetrating hole opened toward one end side of the extended portion, because the hanging member can be laterally inserted to be simply mounted to the hole in the state in which the hanger is engaged with the duct.

According to the second invention, there is provided a method for hanging a duct having a box-shaped cross section and provided with right and left guide rails protruding in a longitudinal direction of the duct so as to form a groove-shaped space between the guide rail and one of peripheral faces of the duct in which the guide rail is formed, by using the guide rails and the hanger according to the first invention, comprising: inserting a tongue piece of the hanger into the groove-shaped space of the duct; and bending a pressing portion toward the guide rail to press a face adjacent to the one peripheral face of the duct, thereby fixing the hanger to the duct.

According to the hanging method having such proceedings, the duct can be easily and quickly hung by means of the hanging member. Besides, if the duct is subjected to the external force from downward, it remains engaged without "play". Further, the opposite sides of the duct can be hung at different positions.

According to the duct hanger and the hanging method using the hanger according to the invention, a hanging operation can be easily and quickly carried out and the duct remains engaged if the upward acceleration (external force) is applied on the duct.

Since the hanger, and the hanger particularly according to Claim 2 can be manufactured by press-forming, easily and with a high extraction rate, it can be embodied at a low cost as compared to the conventional hanger.

BEST MODE FOR CARRYING OUT THE INVENTION

Hereinafter, a hanger and a hanging method using the hanger according to embodiments of the present invention will be described in detail with reference to accompanying drawings.

Figure 1:
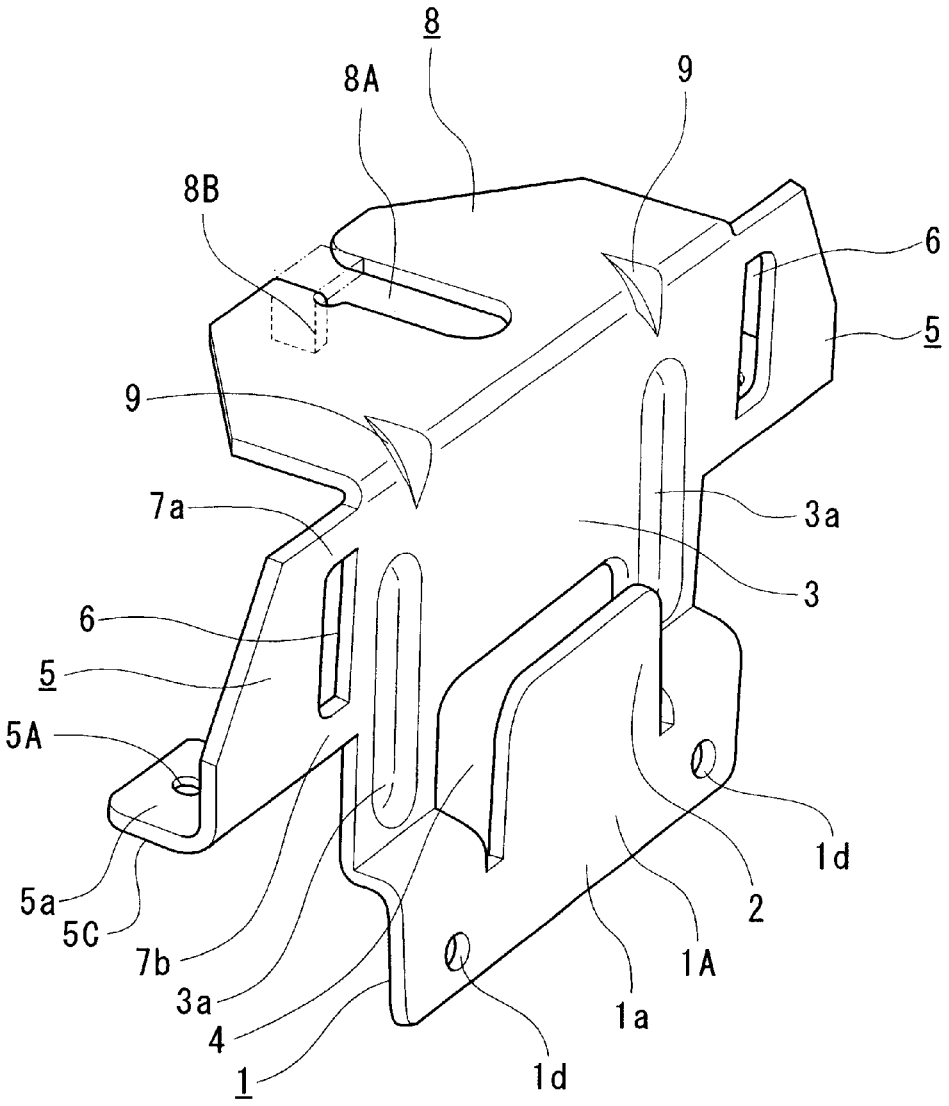
FIG. 1 is a perspective view showing a structure of a duct hanger according to an embodiment of the first invention.

In FIG. 1, reference numeral 1 denotes a contact portion having a contact face (contact portion) 1A as an inner face (one face of the contact portion) which makes contact with a face D1 (see FIG. 3) of a duct D, and a tongue piece 2 is provided at a tip end portion of the contact portion 1 such that it protrudes toward the tip end thereof. Circular holes 1d for mounting to the duct are formed at opposite ends of a lower end portion 1a of the contact portion 1. In this embodiment, the contact portion 1 and the tongue piece 2 are formed as a flat plate. That is, front faces of them are coplanar with each other and rear faces of them are coplanar with each other. A base portion 3 is bent continuously with the contact portion 1 and the tongue piece 2 such that the base portion 3 is spaced apart from the face D1 of the duct D, that is, toward the opposite side of the duct D with respect to the tongue piece 2. In this embodiment, the base portion 3 is a flat plate parallel to the flat plate formed by the contact portion 1 and the tongue piece 2. To increase rigidity, the base portion 3 is provided with concave portions 3*a* of an elongated circle shape seen from the side of the duct D.

A guide rail accommodating space 4 having a rectangular cross section is formed between the base portion 3 and the tongue piece 2. In this embodiment, three sides of the tongue piece 2 is cut out of one plate so as to conform to the outer shape thereof. Also, the tongue piece 2 and contact portion 1, and a portion continuous with the base portion 3 are formed by press-forming so that the tongue piece 2 and the contact portion 1 become the flat plate parallel to the base portion 3. Pressing portions 5 are formed at opposite end portions of the base portion 3. In this embodiment, a penetrating hole 6 is formed in a portion between the base portion 3 and each of the pressing portions 5, as means for facilitating the bending of the pressing portion 5 from the base portion 3 toward the duct D (see a bent state of FIG. 2). The penetrating holes 6 have substantially-D shaped openings (In FIG. 1, the penetrating hole 6 on the right side is substantially D-shaped and the penetrating hole 6 on the left side is substantially inverted-D shaped). Therefore, the base portion 3 and each of the pressing portions 5 are connected by a connecting portion 7*a* above the penetrating hole 6 and a connecting portion 7*b* below the penetrating hole 6. The pressing portions 5 are configured such that lower end portions 5*a* thereof are bent by substantially 90 degrees and away from the duct D in FIG. 1 to enable surface contact with a face D2 adjacent to the face of the duct D. A circular hole 5A for fixation to the duct is formed in each of the lower end portions 5*a*. An extended portion 8 for mounting is formed on the upper side of the base portion 3 such that it is bent away from the duct so as to form substantially 90 degrees with respect to the base portion 3. An elongated hole 8A as a mounting means is formed in the extended portion 8. One end of the elongated hole 8A (one end on the tip end side of the extended portion 8) is opened toward an end face. A hole width w of the elongated hole 8A is slightly larger than a diameter of a "round rod member 13 (see FIG. 3) on which a male screw is screwed", for example, as a hanging member hanging from a ceiling or the like, and at least smaller than an outer diameter of a nut screwed on the male screw. A closing piece 8B for closing the open end of the elongated hole 8A is formed at the open end of the elongated hole 8A such that the closing piece 8B is bent by substantially 90 degrees in the longitudinal direction of the base portion 3. V-shaped portions (notch forming portions) 9 are formed at a bent portion of the base portion 3 and the extended portion 8. By increasing a section modulus of the bent portion in order to increase the rigidity of the bent portion, it becomes difficult that the extended portion 8 is angularly displaced with respect to the base portion 3.

Figure 2:
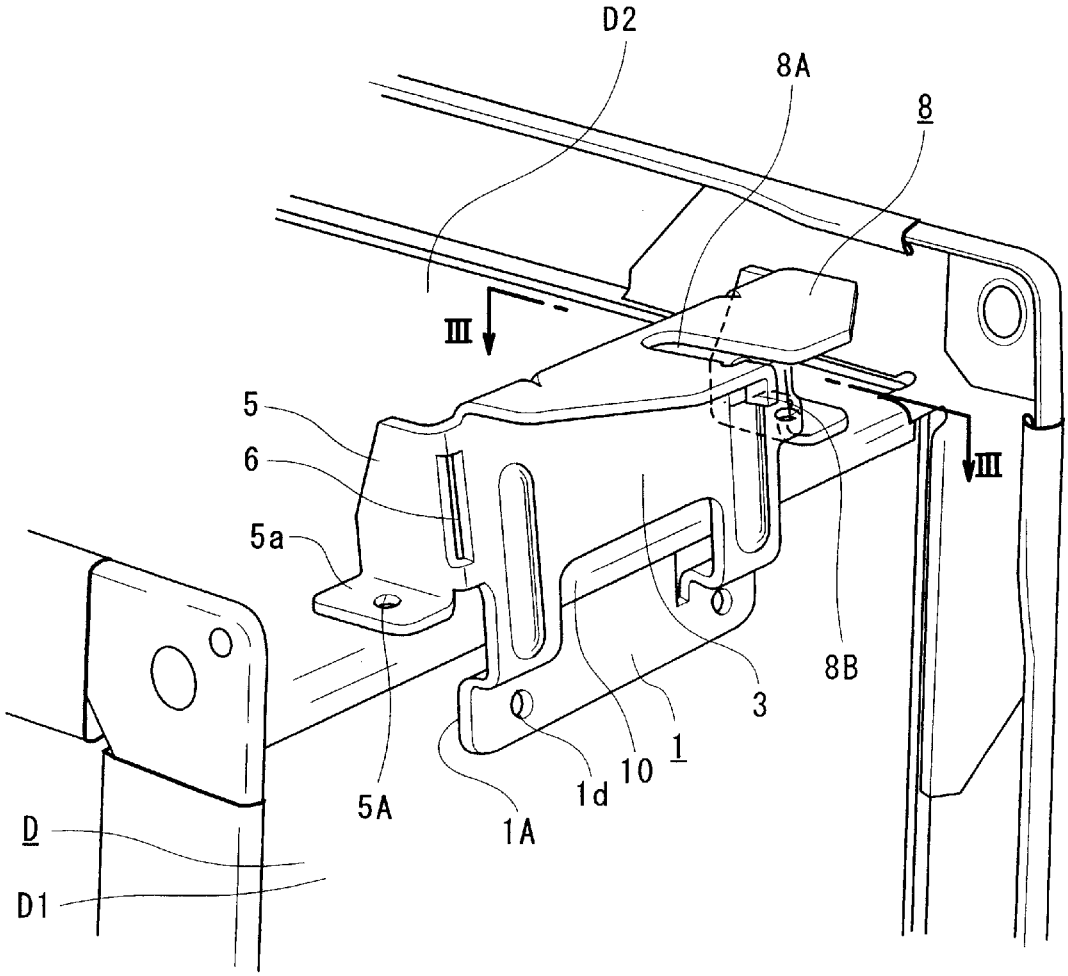
FIG. 2 is a perspective view showing the state in which the duct hanger of FIG. 1 is mounted to the duct.
Figure 3:
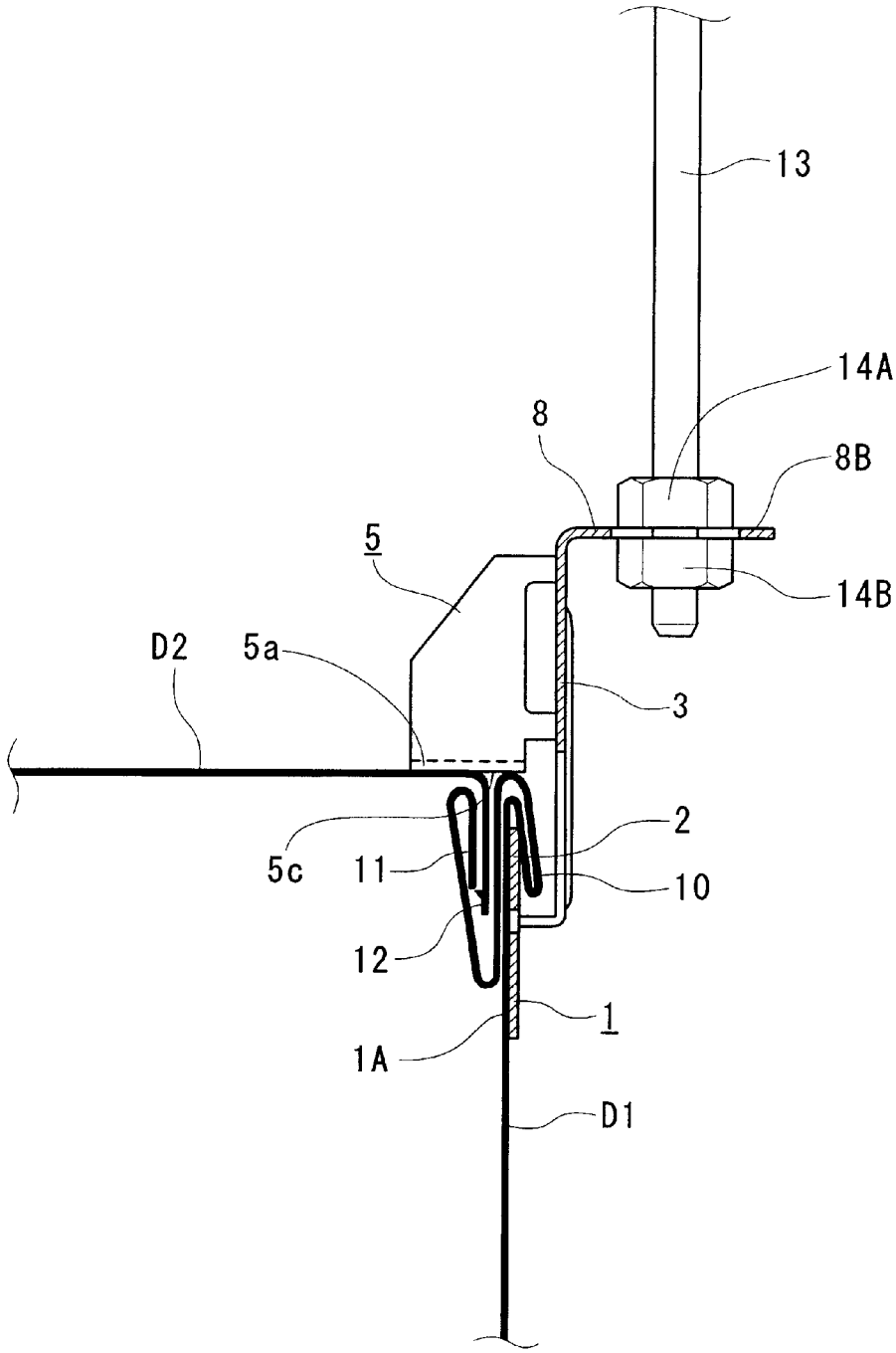
FIG. 3 is a view taken in the direction of the arrows substantially along the line III—III of FIG. 2 and showing the state in which the duct is hung by means of the hanger of FIGS. 1, 2 and by using a hanging member.

The duct D hung by means of the hanger is provided with guide rails 10 at opposite ends thereof such that the rails 10 protrude in the longitudinal direction of the duct D, as shown in FIGS. 2, 3 each showing one side of the duct D. As can be clearly shown in FIG. 3, the guide rail 10 is formed at the tip end portion of the face D1 of the duct D by folding back a member of the duct D in inverted-J shaped (in cross section) double fold so as to form a cuneal (groove-shaped) clearance (space) S between the guide rail 10 and the face D1. As shown in FIG. 3, on the opposite side of the guide rail 10 with respect to the face D1 at a tip end portion of the face D1 that is forward of the guide rail 10, a "female" portion (seam groove) 11 of a lock seam joint structure is formed by folding back the member into a V-shaped groove and further folding back the tip end portion thereof inwardly. An insertion portion 12 corresponding to a "male" portion of the "lock seam joint structure" and provided at the tip end of a member having an outer face adjacent to the face D1 of the duct D is inserted into the seam groove 11, thereby forming a joint of the duct D. A so-called "return" engagement piece 12A is formed at the tip end of the insertion portion 12 to prevent the insertion portion 12 from being disengaged from the seam groove 11.

While one corner portion having a box-shaped rectangular cross section is shown in FIG. 3, four corner portions having a rectangular cross section are formed in this embodiment.

The duct hanger so configured is capable of hanging the duct as described below. Hereinafter, function of the duct hanger and the method for hanging the duct using the duct hanger will be described.

Specifically, the tip end of the tongue piece 2 of the duct hanger of FIG. 1 is inserted into the cuneal (groove-shaped) space S formed between the guide rail 10 of the duct D (see FIGS. 2, 3) and the face D1 in the state in which the face comprising the contact face 1A of the contact portion 1 and a contact face 2A as the inner surface of the tongue piece 2 is in surface contact with the face D1 of the duct D. In this state, as shown in FIGS. 2, 3 (particularly in FIG. 3), the guide rail 10 is accommodated in the guide rail accommodating space 4 formed between the base portion 3 and the tongue piece 2 and, the lower ends of the pressing portions 5 are substantially as high as the upper end of the duct D in the vertical direction, and more precisely, slightly higher than the upper end of the duct D.

Then, in this state, the pressing portions 5 are bent by substantially 90 degrees toward the duct D as shown in FIG. 2 from the state of FIG. 1. In view of function and effects, the bending angle may be 90 degrees or less (for example, approximately 45 degrees) or otherwise 90 degrees or more so long as the lower ends 5*c* of the pressing portions 5 are positioned above the upper face (the face D2 adjacent to the face D1) of the duct D.

In this state, if necessary, the duct hanger may be fixed to the duct D by using the circular holes 1*d*, 5A and by means of blind rivets, screws or the like. Then, a pair of upper and lower nuts 14A, 14B are screwed on the round rod member 13 as the hanging member such that these nuts are vertically spaced apart from each other. The elongated hole 8A of the extended portion 8 of the hanger integrally mounted to the duct D is laterally fitted to a portion of the round rod member 13 that is situated between the pair of upper and lower nuts 14A, 14B. In this state, one of or both of the nuts 14A, 14B are fastened so that these nuts can securely sandwich the extended portion 8, and the closing piece 8B of the elongated hole 8A is bent by substantially 90 degrees to be continuous with a peripheral face of the elongated hole 8A, thereby closing the opened portion of the elongated hole 8A (see FIG. 3).

The hanger is capable of easily hanging the duct D by the above-described series of steps.

Figure 4:
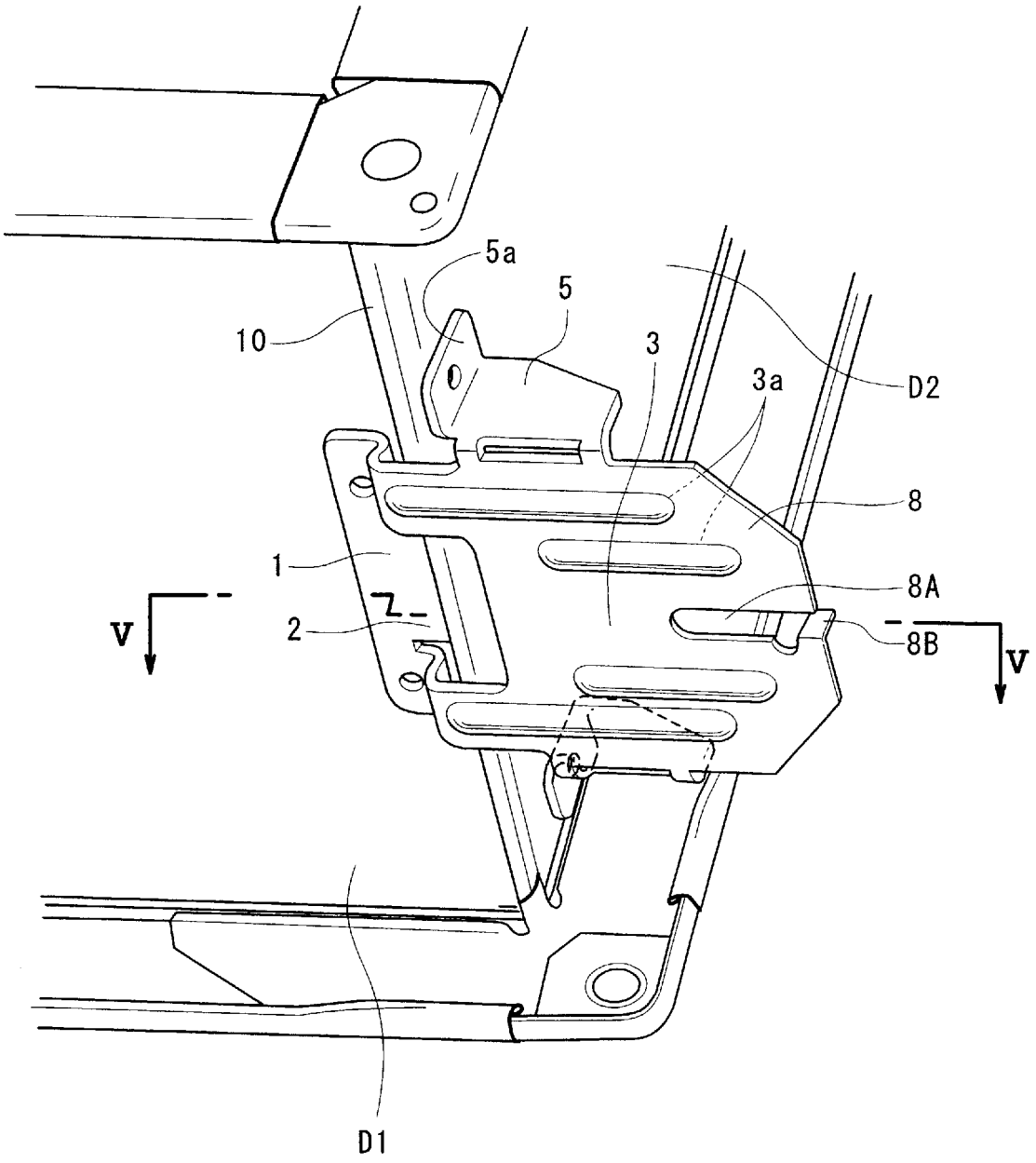
FIG. 4 is a perspective view showing the state in which a hanger having a configuration different from that of FIG. 1 is mounted to the duct so that the lower end portion of the duct can be hung by means of the hanger.
Figure 5:
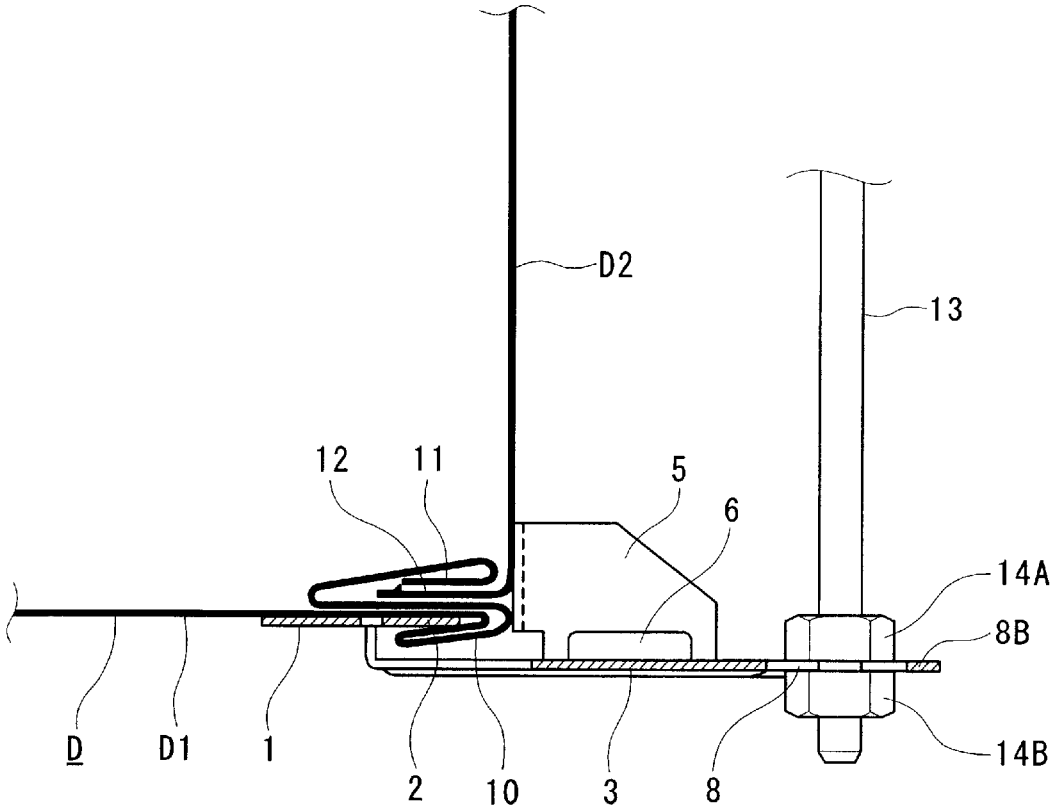
FIG. 5 is a view taken in the direction of the arrows substantially along the line V—V of FIG. 4 and showing the state in which the duct is hung by means of the hanger of FIG. 4 and by using the hanging member.

As an alternative of the above embodiment, as shown in FIGS. 4, 5, the duct D can be hung by using the hanger in which the extended portion 8 is coplanar with the base portion 3 and the guide rail 10 formed at the lower end of the duct D. This means that the same function and effects are achieved if the duct D is used in the state in which the joint portion thereof is rotated 90 degrees. In FIGS. 4, 5, the same reference numerals denote the same or corresponding portions of the embodiments of FIGS. 1–3.

As the penetrating hole as the "facilitating means", the penetrating hole 6 (see FIG. 1) may be replaced by a circular hole or otherwise may be of another shapes so long as the hole 6 can reduce the rigidity in bending.

Figure 6:
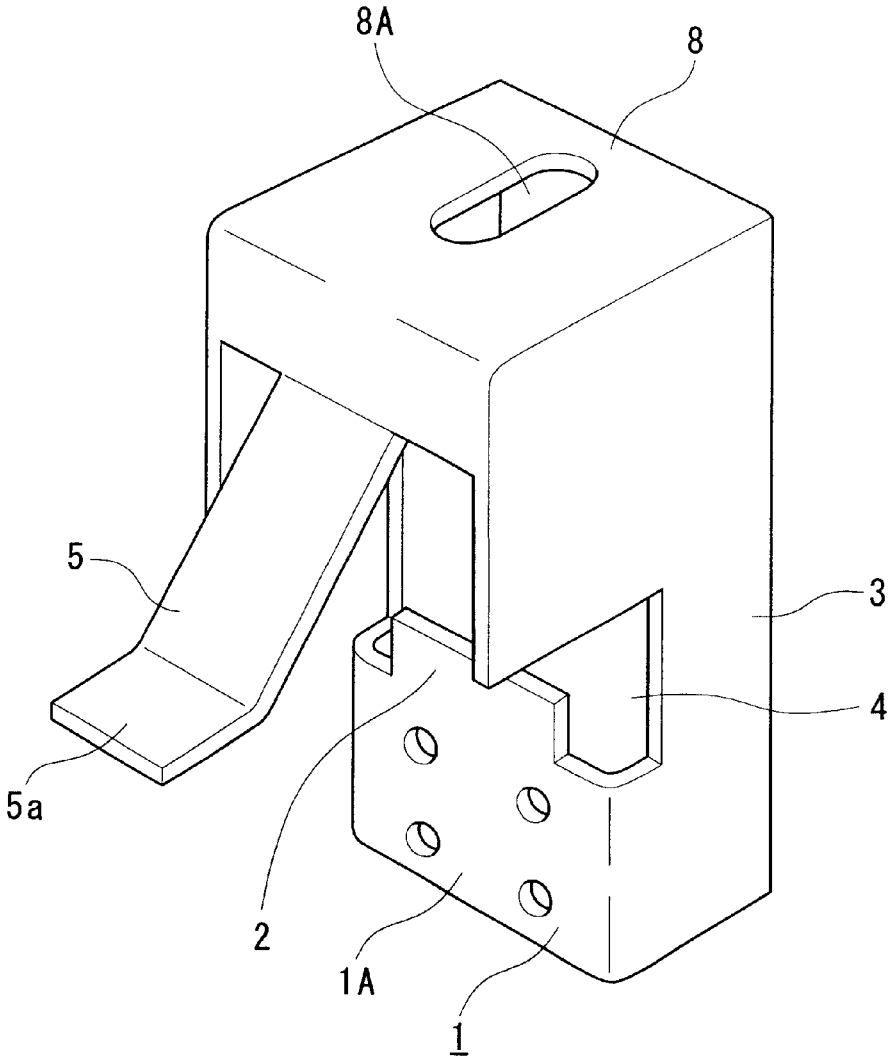
FIG. 6 is a perspective view showing the configuration of a hanger according to another embodiment.
Figure 7:
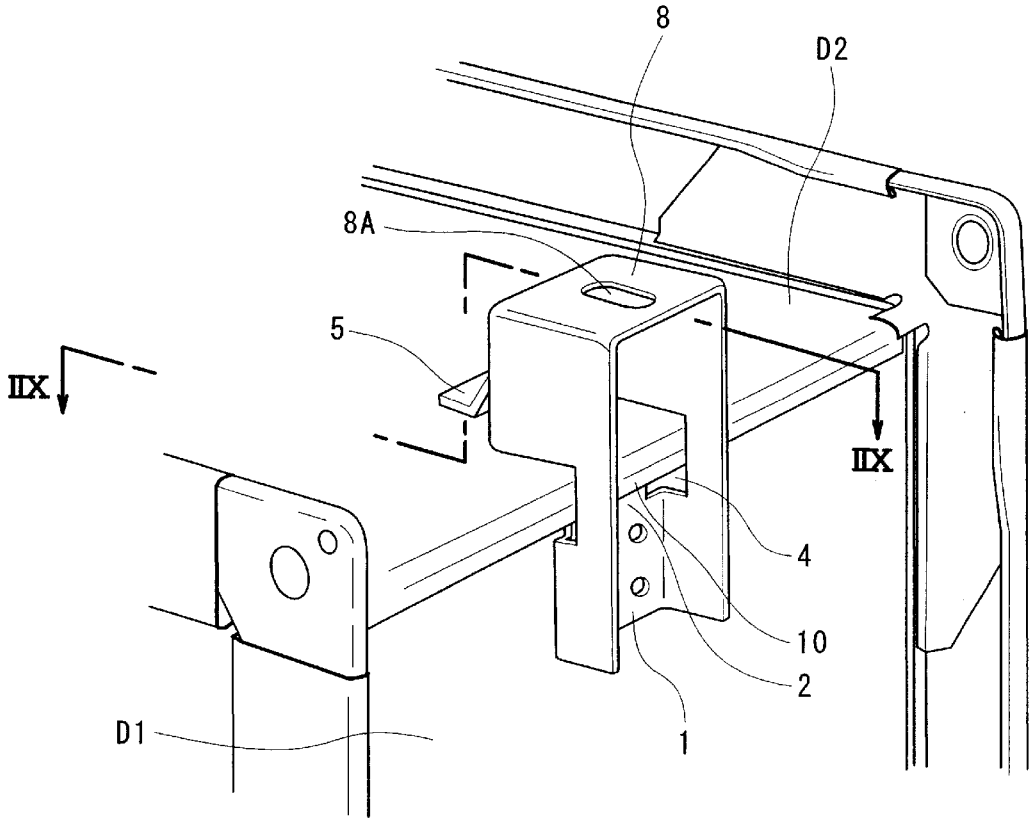
FIG. 7 is a perspective view showing the state in which the duct hanger of FIG. 6 is mounted to the duct.
Figure 8:
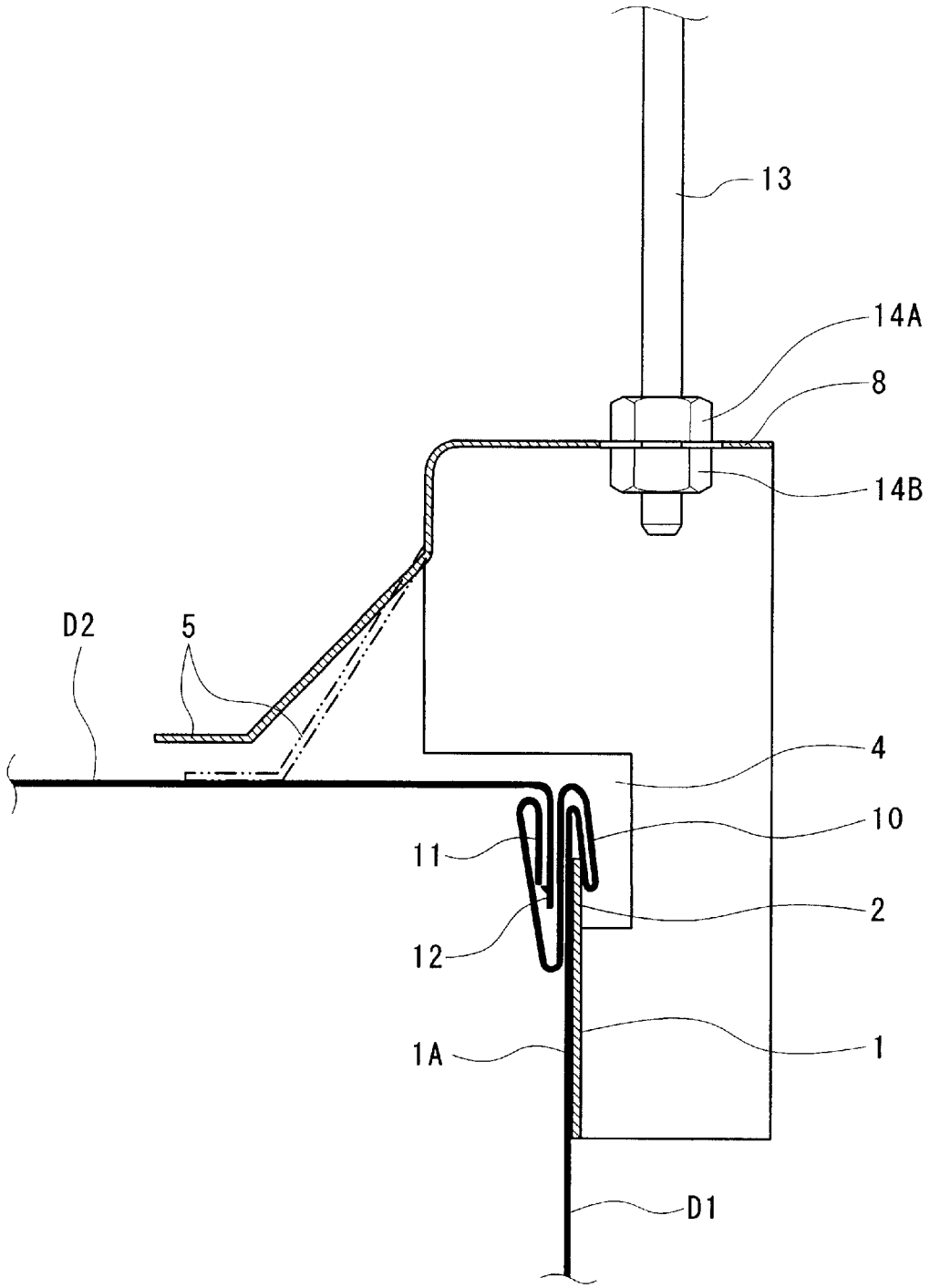
FIG. 8 is a view taken in the direction of the arrows substantially along the line IIX—IIX of FIG. 7 and showing the state in which the duct is hung by means of the hanger of FIGS. 6, 7 and by using the hanging member.
Figure 9:
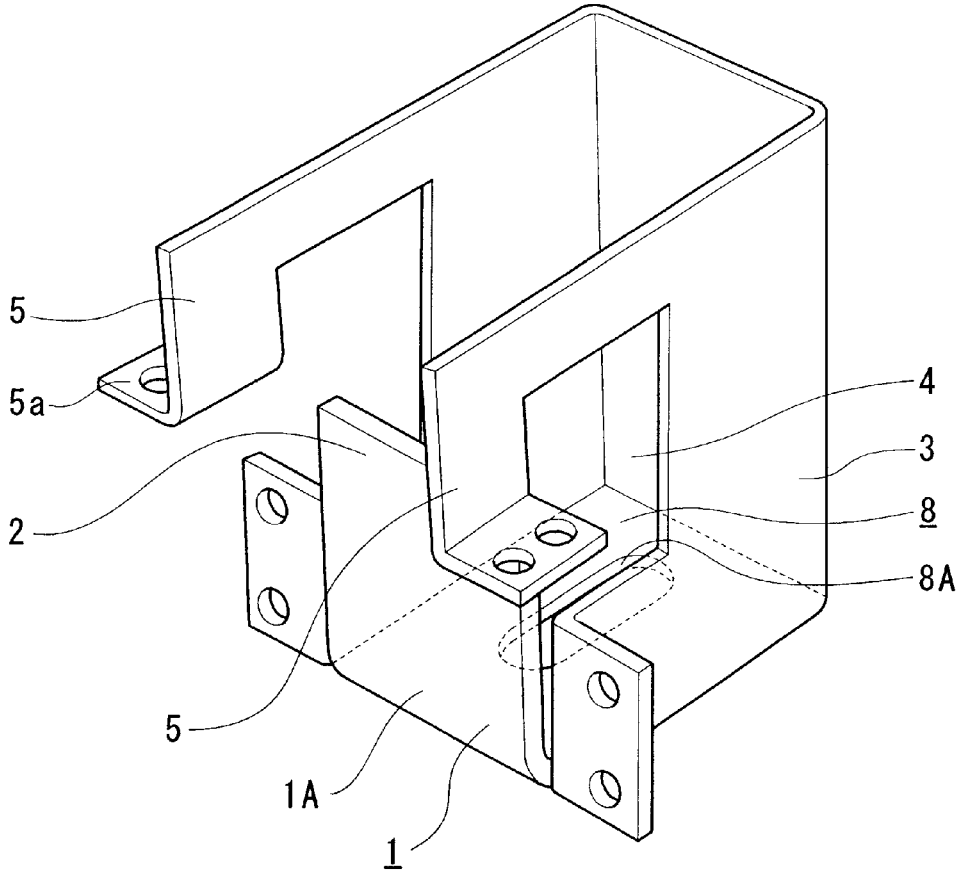
FIG. 9 is a perspective view showing the configuration of a hanger according to another embodiment.
Figure 10:
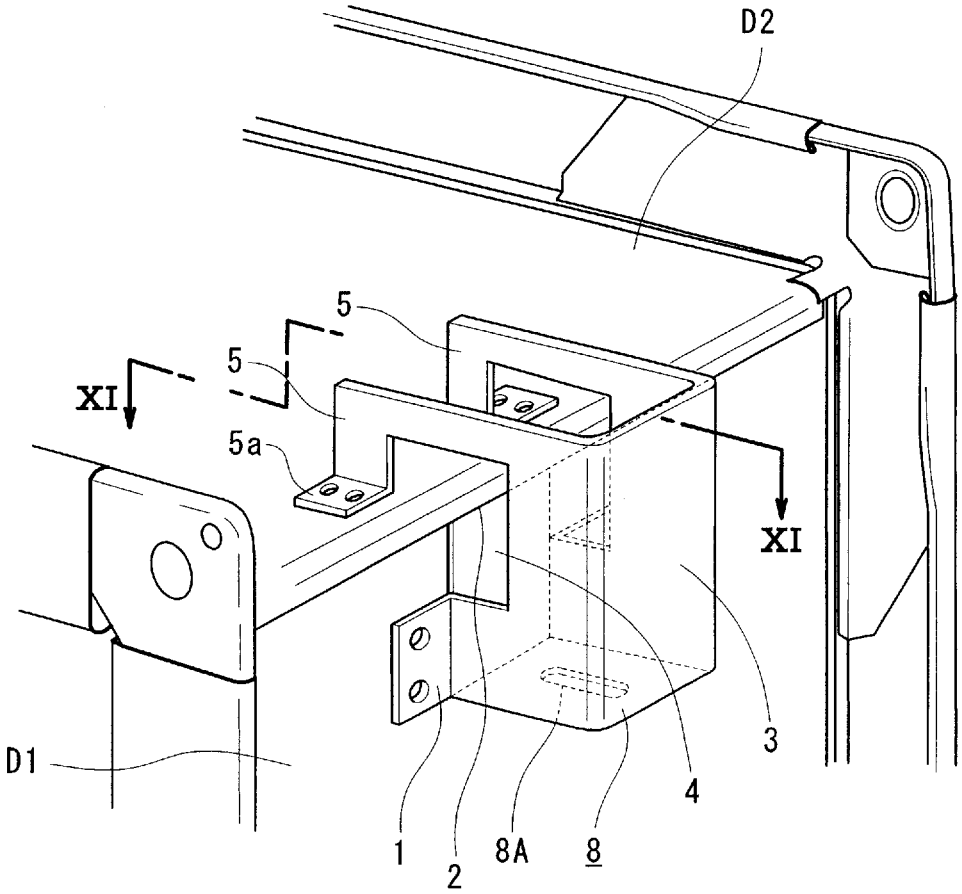
FIG. 10 is a perspective view showing the state in which the duct hanger of FIG. 9 is mounted to the duct.
Figure 11:
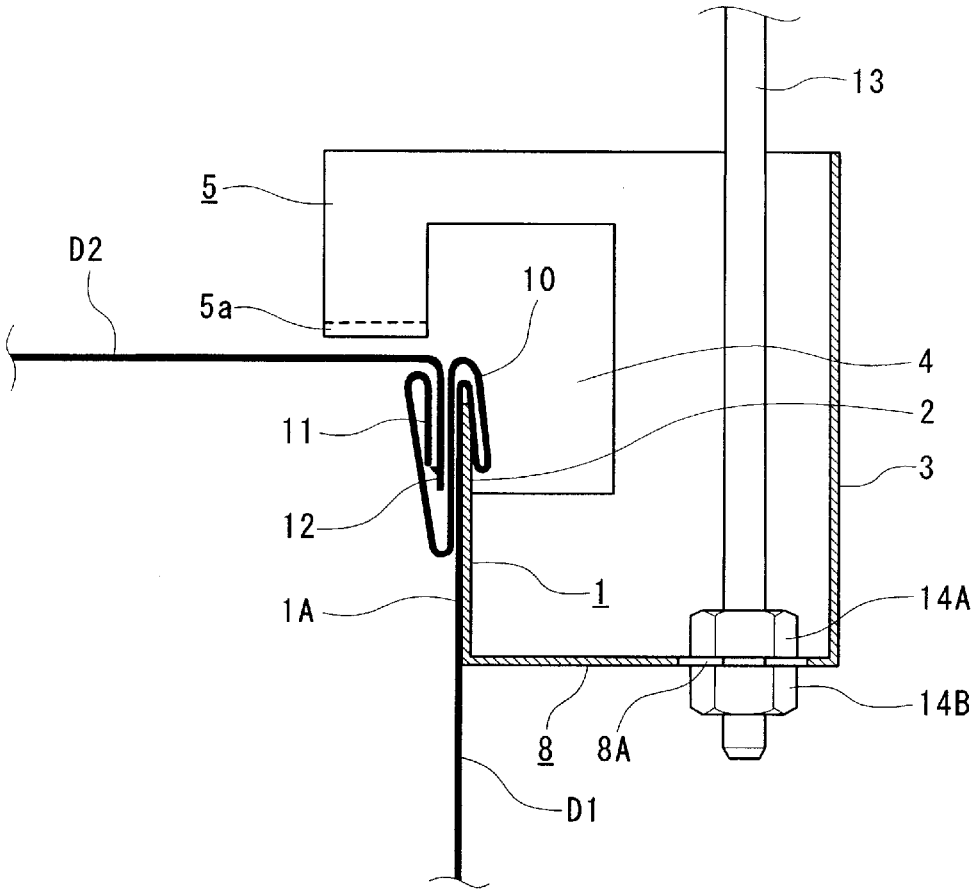
FIG. 11 is a view taken in the direction of the arrows substantially along the line XI—XI of FIG. 10 and showing the state in which the duct is hung by means of the hanger of FIGS. 9, 10 and by using the hanging member.
Figure 12:
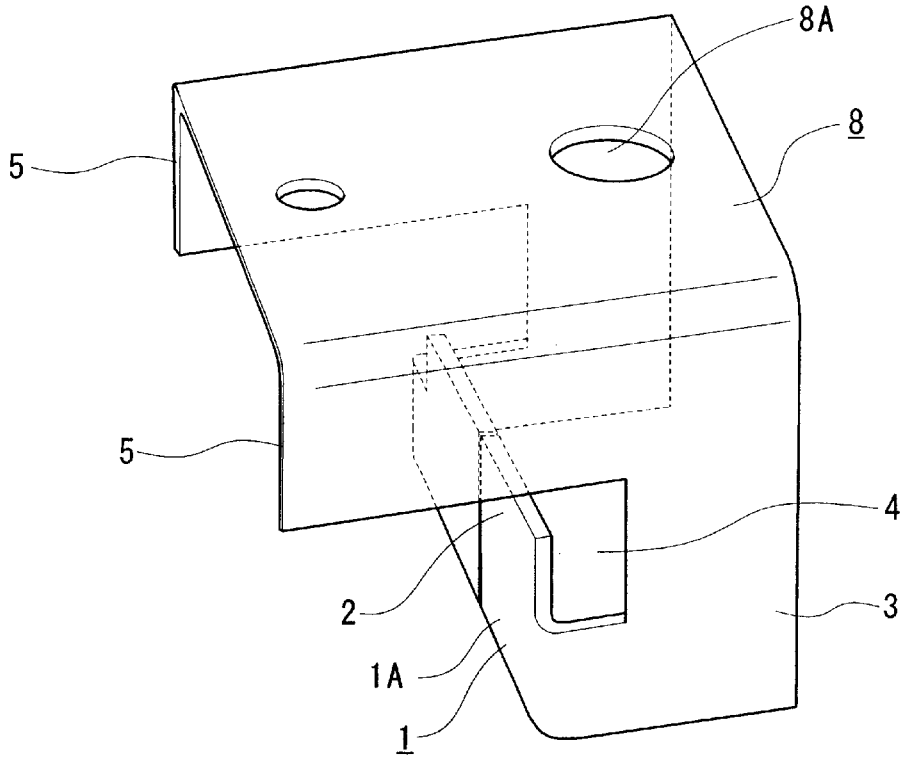
FIG. 12 is a perspective view showing the configuration of a hanger according to another embodiment.
Figure 13:
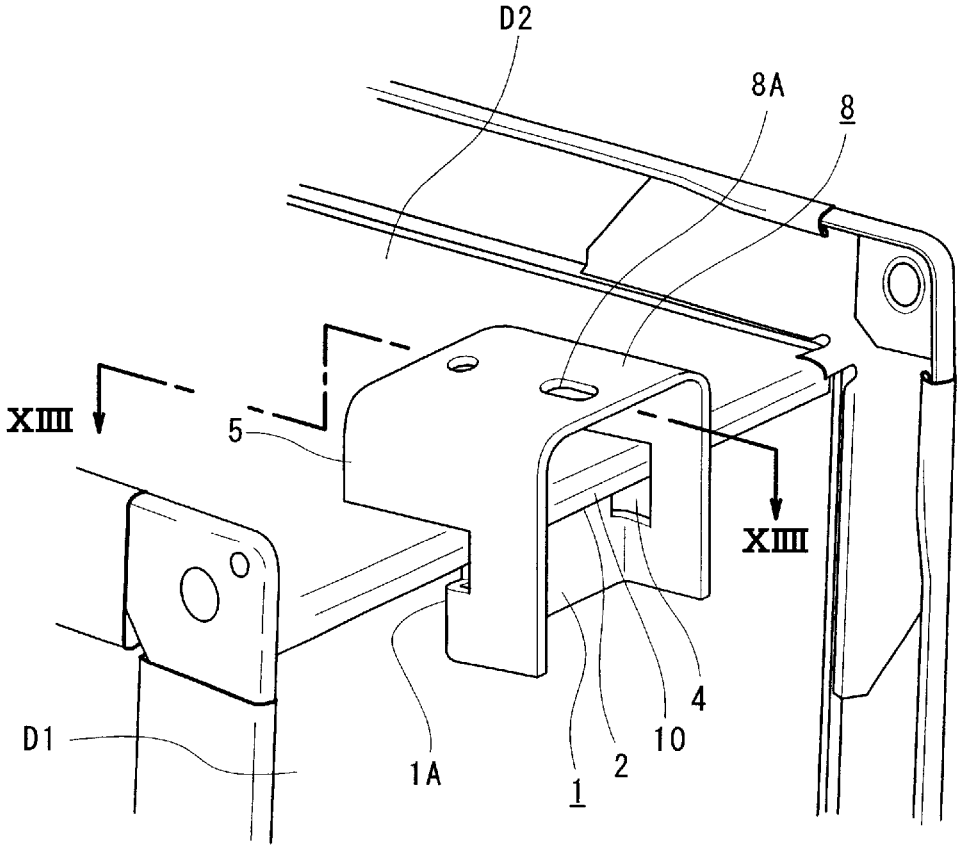
FIG. 13 is a perspective view showing the state in which the duct hanger of FIG. 12 is mounted to the duct.
Figure 14:
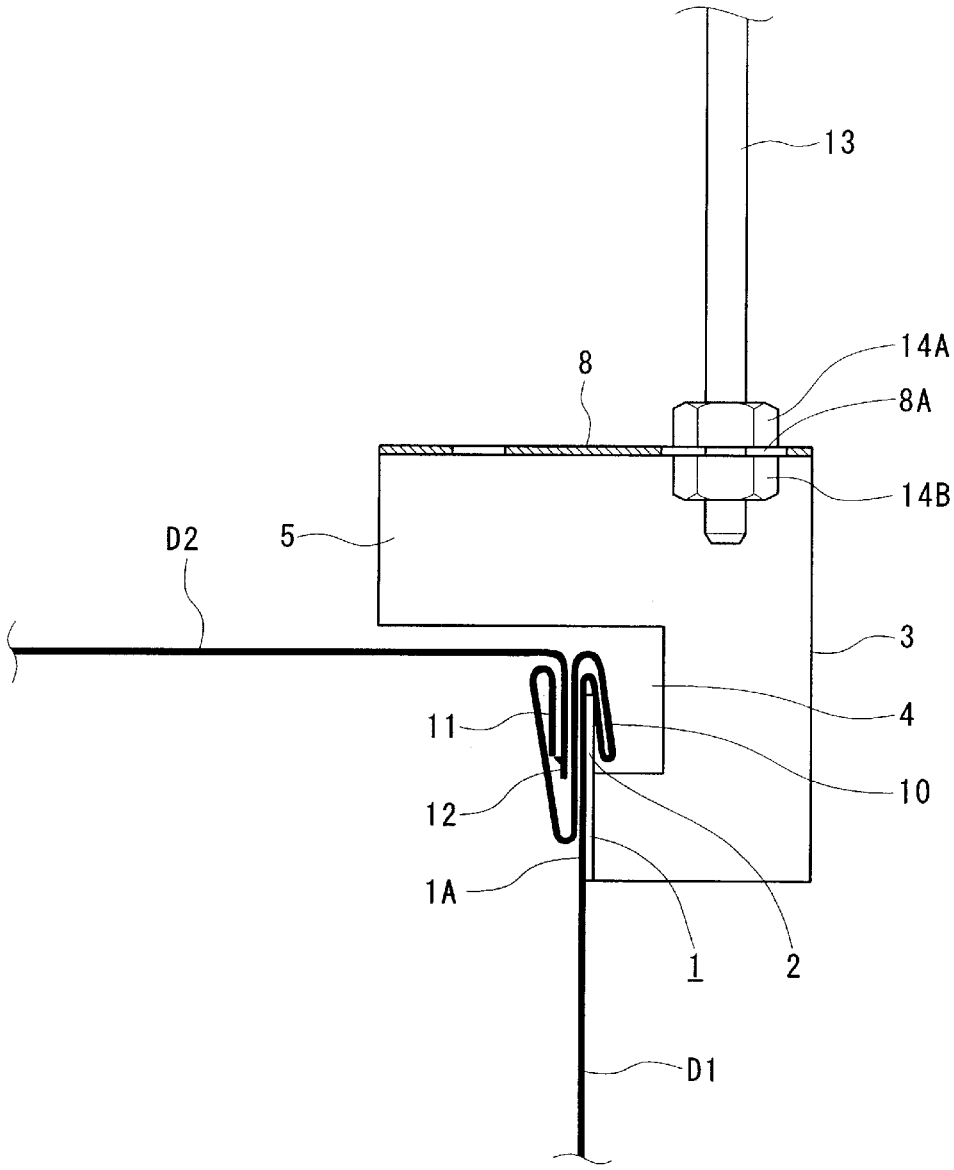
FIG. 14 is a view taken in the direction of the arrows substantially along the line XIIII—XIIII of FIG. 13 and showing the state in which the duct is hung by means of the hanger of FIGS. 12, 13 and by using the hanging member.
Figure 15:
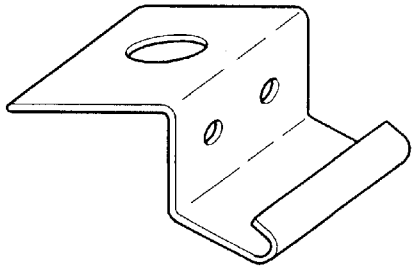
FIG. 15 are views showing the configuration of the conventional hanger of the applicant, wherein FIG. 15(*a*) is a view showing the configuration of the hanger and FIG. 15(*b*) is a view showing the hanging state.
Figure 15:
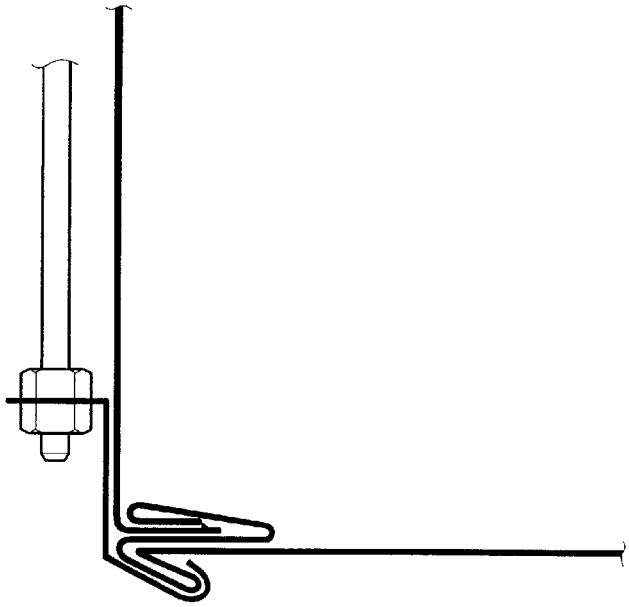
Figure 16:
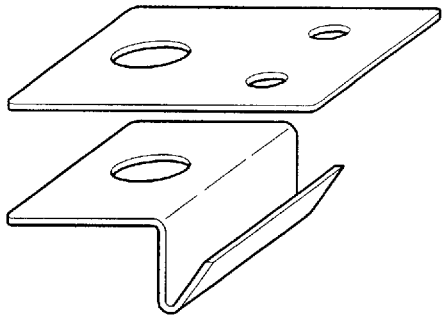
FIG. 16 are views showing the configuration of the conventional hanger of the applicant that is different from the hanger of FIG. 9, wherein FIG. 16(*a*) is a view showing the configuration of the hanger and FIG. 16(*b*) is a view showing the hanging state.
Figure 16:
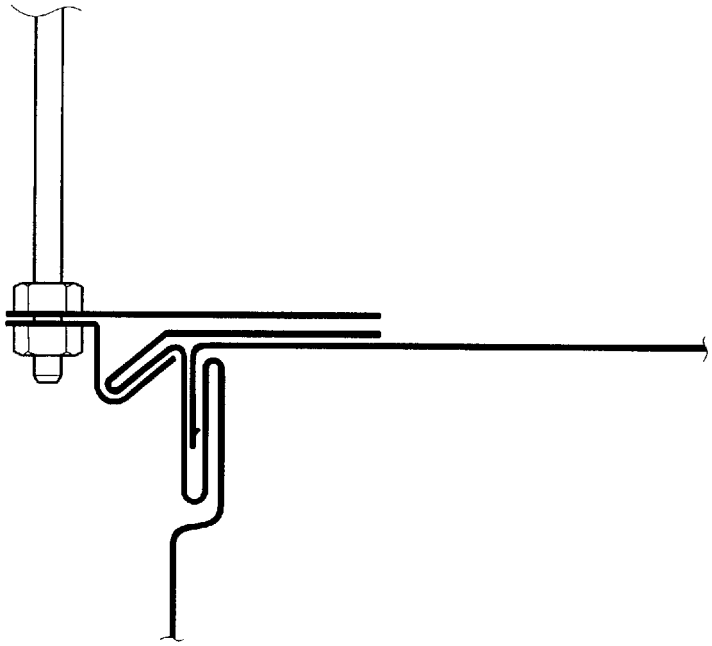

In the above embodiment, the pressing portions are formed by bending when the hanger is fixed to the duct D. Alternatively, as shown in each of embodiments of FIGS. 6–8, FIGS. 9–11, and FIGS. 12–14, the pressing portions may have a fixed configuration to securely retain the guide rail 10 between the pressing portion and the tongue piece. In this case, the pressing portions may have some elasticity as shown in FIG. 8. In the embodiments of FIGS. 6–8, it is preferable that the pressing portions are fixed to the duct D by means of rivets, screws, or the like because the hanger can be firmly fixed to the duct D. In each of the embodiments of FIGS. 6–14, the reference numerals of the embodiments of FIGS. 1–3 denote the same or corresponding portions.

In the case of each of the hangers of FIGS. 6–14, not to mention the hangers of FIGS. 1–3, even if the duct D hung by means of the hanging member (round rod member) is subjected to the external force from downward, the duct D remains engaged with the hanger, because a space h5 between the lower end of the pressing portion 5 and the upper face of the duct D is smaller than an engagement dimension h2 of the tongue piece 2 into the cuneal space S of the guide rail portion 10.

What is claimed is:

1. A duct hanger in which an engagement means is inserted and engaged in a groove-shaped space between a guide rail protruding in a longitudinal direction of a duct and one of peripheral faces of the duct in which the guide rail is formed to allow the duct to be hung from a direction orthogonal to the longitudinal direction of the guide rail, the duct hanger comprising:

a contact portion that makes surface contact with the one peripheral face of the duct;

a tongue piece protruding from the contact portion toward a tip end thereof and constituting the engagement means;

a base portion bent continuously with the contact portion and away from the duct so as to form a guide rail accommodating space between the base portion and the tongue piece;

a pressing portion formed continuously with the base portion, for pressing a face adjacent to the one peripheral face toward a tip end of the tongue piece to allow the guide rail to be securely retained between the pressing portion and the tongue piece; and means for mounting a hanging member to the base portion.

2. The hanger according to claim 1, wherein the pressing portion is coplanar with the base portion and, when the duct is hung, the pressing portion is bent toward the guide rail to allow the guide rail to be securely retained between the pressing portion and the tongue piece.

3. A method for hanging a duct having a box-shaped cross section and provided with right and left guide rails protruding in a longitudinal direction of the duct so as to form a groove-shaped space between the guide rail and one of peripheral faces of the duct in which the guide rail is formed, by using the guide rails and the duct hanger according to claim 2, comprising:

inserting a tongue piece of the hanger into the groove-shaped space of the duct; and bending a pressing portion toward the guide rail to press a face adjacent to the one peripheral face of the duct, thereby fixing the hanger to the duct.

4. The hanger according to claim 2, further comprising:

means formed between the base portion and the pressing portion, for facilitating bending.

5. The hanger according to claim 4, wherein the facilitating means is a penetrating hole formed at a center of a bent portion.

6. The hanger according to claim 1, wherein the tongue piece and the contact portion are formed as a flat plate, and the base portion is formed as a flat plate parallel to the tongue piece and the contact portion such that the base portion is bent continuously with the contact portion and toward the opposite side of the duct with respect to the tongue piece.

7. The hanger according to claim 6, wherein the mounting means is constituted by a penetrating hole formed in an extended portion that is formed at a tip end of the base portion and bent by substantially 90 degrees with respect to the base portion and away from the guide rail.

8. The hanger according to claim 6, wherein the mounting means is constituted by a penetrating hole formed in an extended portion formed at a tip end of the base portion so as to be coplanar with the base portion.

9. The hanger according to claim 8, wherein the penetrating hole is an elongated penetrating hole opened toward one end side of the extended portion.

* * * * *